US011713655B2

(12) United States Patent
Connor et al.

(10) Patent No.: US 11,713,655 B2
(45) Date of Patent: Aug. 1, 2023

(54) LINER HANGER FOR USE WITH AN EXPANSION TOOL HAVING AN ADJUSTABLE CONE

(71) Applicant: Enventure Global Technology Inc., Houston, TX (US)

(72) Inventors: Eric James Connor, Katy, TX (US); Gregory Marshall Noel, Katy, TX (US)

(73) Assignee: Enventure Global Technology Inc., Houston, TX (US)

( * ) Notice: Subject to any disclaimer, the term of this patent is extended or adjusted under 35 U.S.C. 154(b) by 0 days.

(21) Appl. No.: 17/737,832

(22) Filed: May 5, 2022

(65) Prior Publication Data

US 2022/0259952 A1 Aug. 18, 2022

Related U.S. Application Data

(62) Division of application No. 16/472,988, filed as application No. PCT/US2018/017530 on Feb. 9, 2018, now Pat. No. 11,352,858.

(60) Provisional application No. 62/456,711, filed on Feb. 9, 2017.

(51) Int. Cl.
*E21B 43/10* (2006.01)
*E21B 33/14* (2006.01)

(52) U.S. Cl.
CPC ..... *E21B 43/105* (2013.01); *E21B 33/14* (2013.01)

(58) Field of Classification Search
CPC ..... E21B 43/105; E21B 43/103
See application file for complete search history.

(56) References Cited

U.S. PATENT DOCUMENTS

| | | | | |
|---|---|---|---|---|
| 3,776,307 | A | 12/1973 | Young | |
| 2003/0116325 | A1 | 6/2003 | Cook et al. | |
| 2003/0127225 | A1 | 7/2003 | Harrall et al. | |
| 2004/0216889 | A1 | 11/2004 | Fraser, III | |
| 2004/0245020 | A1* | 12/2004 | Giroux | E21B 17/14 175/171 |
| 2005/0194127 | A1 | 9/2005 | Campo | |
| 2005/0217865 | A1 | 10/2005 | Ring | |
| 2006/0065403 | A1 | 3/2006 | Watson et al. | |
| 2007/0227730 | A1 | 10/2007 | Brisco et al. | |
| 2009/0200040 | A1* | 8/2009 | Smith, Jr. | E21B 43/103 166/380 |
| 2010/0147535 | A1 | 6/2010 | Gorrara et al. | |
| 2011/0011578 | A1* | 1/2011 | Noel | B21D 39/20 166/380 |
| 2011/0277299 | A1 | 11/2011 | Deible et al. | |
| 2012/0298379 | A1 | 11/2012 | Van Riet et al. | |

(Continued)

*Primary Examiner* — Theodore N Yao
(74) *Attorney, Agent, or Firm* — Jonathan Pierce; Pierre Campanac; Porter Hedges LLP

(57) ABSTRACT

A liner hanger is used for deploying a liner into a wellbore. The liner hanger includes a tubular body having a first end and a second end. The first end can include a connection to a liner. The second end can include a sealed connection to an operational pipe. The sealed connection can be releasable. An expansion tool attached to a work string can be used for suspending the liner hanger into the wellbore. At least a portion of the expandable pipe is radially expanded using the expansion tool. The radial expansion of the expandable pipe can cause compression of at least one seal member against a base casing.

10 Claims, 7 Drawing Sheets

(56) References Cited

U.S. PATENT DOCUMENTS

| | | | | |
|---|---|---|---|---|
| 2013/0299197 | A1 | 11/2013 | Bennett et al. | |
| 2014/0196953 | A1 | 7/2014 | Chitwood et al. | |
| 2015/0292305 | A1* | 10/2015 | Galloway | E21B 43/103 166/380 |
| 2017/0226828 | A1* | 8/2017 | Brisco | E21B 43/103 |
| 2018/0119527 | A1 | 5/2018 | Jabs et al. | |

* cited by examiner

LINER HANGER FOR USE WITH AN EXPANSION TOOL HAVING AN ADJUSTABLE CONE

CROSS-REFERENCE TO RELATED APPLICATIONS

This application is a divisional application claiming the benefit of priority under 35 U.S.C § 121 to U.S. application Ser. No. 16/472,988, filed on Jun. 24, 2019, which is a national stage entry of International application serial no. PCT/US2018/017530, filed on Feb. 9, 2018, which claims the benefit of priority to U.S. provisional application Ser. No. 62/456,711, filed on Feb. 9, 2017.

U.S. application Ser. No. 16/472,988, International application serial no. PCT/US2018/017530, and U.S. provisional application Ser. No. 62/456,711 are incorporated herein by reference for all and any purposes.

BACKGROUND

The disclosure relates to methods and apparatus for the deployment of a liner in a wellbore. More particularly, the disclosure relates to liner hangers for use with an expansion tool having an adjustable cone, and to methods of deploying liners using such liner hangers.

A liner hanger usually comprises a tubular body connected to a liner to be deployed in a wellbore. The tubular body is typically not radially expanded during deployment. Instead, extendable slips may be provided on an outer surface of the tubular body for anchoring the tubular body to a base casing. A deformable packer may also be provided on the outer surface of the tubular body for sealing an annular space between the tubular body and the base casing after the liner has been cemented in the wellbore. The extendable slips and the deformable packer may be actuated by increasing the fluid pressure inside the tubular body relative to the fluid pressure outside the tubular body. The liner hanger and the liner may be deployed in the wellbore using a run-in tool coupled at a downhole end of a work string. The run-in tool may comprise a plurality of retractable dogs for locking the run-in tool to an inner groove of the liner hanger while tripping in the wellbore. To release the liner hanger from the run-in tool once the liner hanger is set in the base casing, the dogs may be retracted by shifting a sleeve retaining the dogs. The sleeve may be actuated by increasing the pressure upstream of a ball obstructing the flow of fluid through the tubular body of the liner hanger.

The extendable slips and the deformable packer may prematurely be actuated when a pressure differential develops across the tubular body. For example, the pressure differential may develop when the drilling mud being circulated generates viscous drag, that is, the difference between the circulating pressure and the hydrostatic pressure is high. The pressure differential may also develop when the fluid present inside the work string has a density that is sufficiently higher than the density of the fluid present outside of the work string. Further, the liner hanger may release from the run-in tool dogs under excessive loads. Still further, the liner hanger may not release from the run-in tool even after a ball is dropped in the work string. For example, a ball seat on which the ball lands may have washed out and the ball may not properly seal against the seat.

Thus, there is a continuing need in the art for new methods and apparatus for the deployment of a liner in a wellbore. To improve the reliability of the deployment operations, these new methods and apparatus preferably involve liner hangers and run-in tools requiring fewer moving parts, fewer activations ports, and fewer pressure cycles to complete the deployment of the liner.

SUMMARY

In some aspects, the disclosure describes a method of using a liner hanger. The liner hanger may include a tubular body having a first end and a second end, an expandable pipe, and a launcher chamber located longitudinally between the first end of the tubular body and the expandable pipe. The first end of the tubular body may include a connection to a liner. The expandable pipe has a first inner diameter, and the launcher chamber has a second inner diameter that may be larger than the first inner diameter.

The method may comprise the steps of attaching an expansion tool to a work string and/or suspending the liner hanger from a deck of a drilling rig. Alternatively, the method may comprise the steps of suspending the liner hanger and an expansion tool from the deck of the drilling rig, and/or attaching the expansion tool to the work string.

The method may comprise the step of inserting an adjustable cone of an expansion tool through the expandable pipe into the launcher chamber while the adjustable cone is in a retracted configuration in which an outer diameter of the adjustable cone is less than the first inner diameter of the expandable pipe. Inserting the adjustable cone through the expandable pipe may be performed while the liner hanger is suspended from the deck of the drilling rig, or before the liner hanger is suspended from the deck of the drilling rig.

The method may comprise the step of forming the adjustable cone into an expanded configuration, wherein the outer diameter of the adjustable cone is more than the first inner diameter of the expandable pipe. Forming the adjustable cone into the expanded configuration may be performed while the liner hanger is suspended from a deck of a drilling rig or before the liner hanger is suspended from a deck of a drilling rig.

The method may comprise the step of deploying the liner into a wellbore while suspending the liner and the liner hanger from the adjustable cone and the work string. Suspending the liner and the liner hanger from the adjustable cone and the work string may comprise the step of resting a shoulder provided by a transition between the launcher chamber and the expandable pipe on the adjustable cone.

The method may comprise the steps of radially expanding at least a portion of the expandable pipe to the second inner diameter of the launcher chamber, and/or compressing at least one seal member disposed around the expandable pipe against a base casing. Radially expanding at least the portion of the expandable pipe may comprise the step of pumping fluid through the work string into a volume sealed within the tubular body by a cup seal attached to the work string. The volume may be sealed by covering a flow passageway provided through an expansion pressure seat that is attached to the liner hanger with a flapper having an orifice therethrough, and sealing the orifice.

In cases where the second end of the tubular body includes a sealed connection to an operational pipe having a bore, the operational pipe having a third inner diameter that may be larger than the second inner diameter of the launcher chamber, the method may further comprise installing a tie-back liner at least partially into the bore of the operational pipe.

In some embodiments, the method may comprise the steps of collapsing the adjustable cone into the retracted configuration and/or retrieving the expansion tool from the liner hanger. Collapsing the adjustable cone into the retracted configuration may be performed before radially expanding an entire length of the expandable pipe.

In some embodiments, the method may comprise the steps of reinserting the adjustable cone through the expandable pipe into the launcher chamber while the adjustable cone is in the retracted configuration, and/or reforming the adjustable cone into the expanded configuration.

In some embodiments, the method may comprise the steps of applying a torque to the work string, and/or transmitting the applied torque to the liner hanger via a torque transfer nut attached to the work string.

In some aspects, the disclosure describes a liner hanger. The liner hanger may be used for deploying a liner into a wellbore.

The liner hanger may comprise a tubular body having a first end and a second end. The first end may include a connection to a liner. The second end may include a sealed connection to an operational pipe. The sealed connection may be releasable upon radial expanding of an expandable pipe comprised in the liner hanger.

The tubular body may comprise the expandable pipe. The expandable pipe has a first inner diameter. The liner hanger may further comprise at least one seal member. The at least one seal member may be disposed around the expandable pipe.

The tubular body may comprise a launcher chamber. The launcher chamber may be located longitudinally between the first end of the tubular body and the expandable pipe. The launcher chamber has a second inner diameter. The second diameter may be larger than the first inner diameter of the expandable pipe. Also, the operational pipe has a third inner diameter that may be larger than the second inner diameter. At least one groove may be formed in the launcher chamber.

The liner hanger may comprise a shoulder. The shoulder may be provided by a transition between the launcher chamber and the expandable pipe. The launcher chamber may be at least partially formed in a crossover sub threaded to the expandable pipe below the shoulder. The at least one groove may be recessed within an internal surface of the crossover sub.

The liner hanger may comprise an expansion pressure seat attached to the liner hanger. The expansion pressure seat may have a flow passageway. The liner hanger may further comprise a flapper having an orifice therethrough. The flapper may be capable of covering the flow passageway.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
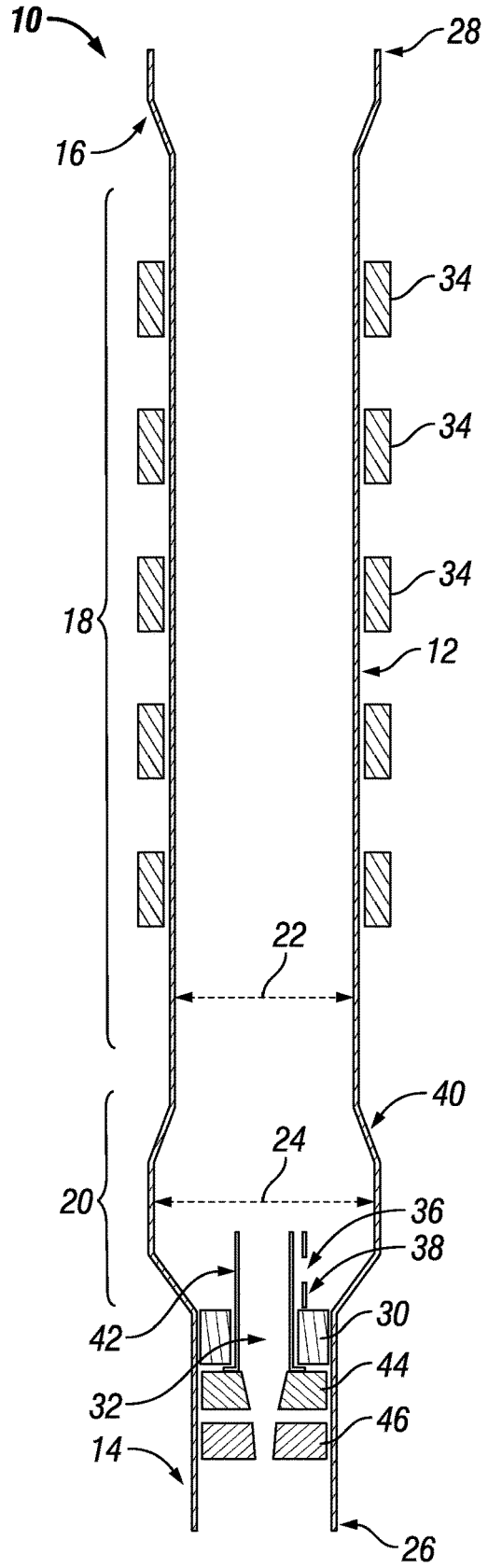
FIG. 1 is a sectional view of a liner hanger shown in a pre-expanded configuration.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

All numerical values in this disclosure may be exact or approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following discussion and in the claims, the terms "including" and "comprising" are used in an open-ended fashion, and thus should be interpreted to mean "including, but not limited to." Furthermore, as it is used in the claims or specification, the term "or" is intended to encompass both exclusive and inclusive cases, i.e., "A or B" is intended to be synonymous with "at least one of A and B," unless otherwise expressly specified herein.

Certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

FIG. 1 illustrates a liner hanger 10 that may be used for deploying a liner 48 (shown in FIGS. 2A-2F) into a wellbore 60 (shown in FIGS. 2A-2F). In this embodiment, the liner hanger 10 comprises a tubular body 12 having a first end 14, and a second end 16. The first end 14 may include a connection 26 to the liner 48. In some embodiments, the second end 16 may include a sealed connection 28 to an operational pipe 68 (shown in FIGS. 2A-2F).

The tubular body 12 includes an expandable pipe 18 and a launcher chamber 20. The launcher chamber 20 is located longitudinally between the first end 14 and the expandable pipe 18. The expandable pipe 18 has a first inner diameter 22. The launcher chamber 20 has a second inner diameter 24 that is larger than the first inner diameter 22. A transition between the launcher chamber 20 and the expandable pipe 18 provides a shoulder 40 that may rest on an adjustable cone 50 (shown in FIGS. 2A-2F) when the adjustable cone 50 is an expanded configuration. The operational pipe 68 may have a third inner diameter that is larger than the second inner diameter 24.

In this embodiment, the liner hanger 10 may comprise an expansion pressure seat 30 attached to the liner hanger 10 and having a flow passageway 32. A flapper 38 having an orifice 36 is mounted on the expansion pressure seat 30. The flapper 38 may have a first position (as shown in FIG. 1) wherein the flapper 38 does not cover the flow passageway 32, and a second position wherein the flapper 38 at least partially covers the flow passageway 32. The flapper 38 may be biased to the second position, for example, using a spring. The flapper 38 may be maintained in the first position with a tube 42.

To cement the liner 48, the liner hanger 10 may include a top wiper plug 44, and a bottom wiper plug 46, that are mounted near the first end 14 of the tubular body 12. Both the top wiper plug 44 and the bottom wiper plug 46 are releasable from the tubular body 12, for example by shearing pins. The tube 42 may be attached to the top wiper plug 44.

The liner hanger 10 comprises at least one seal member disposed around the expandable pipe 18, for example, a plurality of elastomer rings 34.

FIGS. 2A-2F illustrate the deployment of a liner 48 in a wellbore 60 using the liner hanger 10 shown in FIG. 1.

Figure 2A:
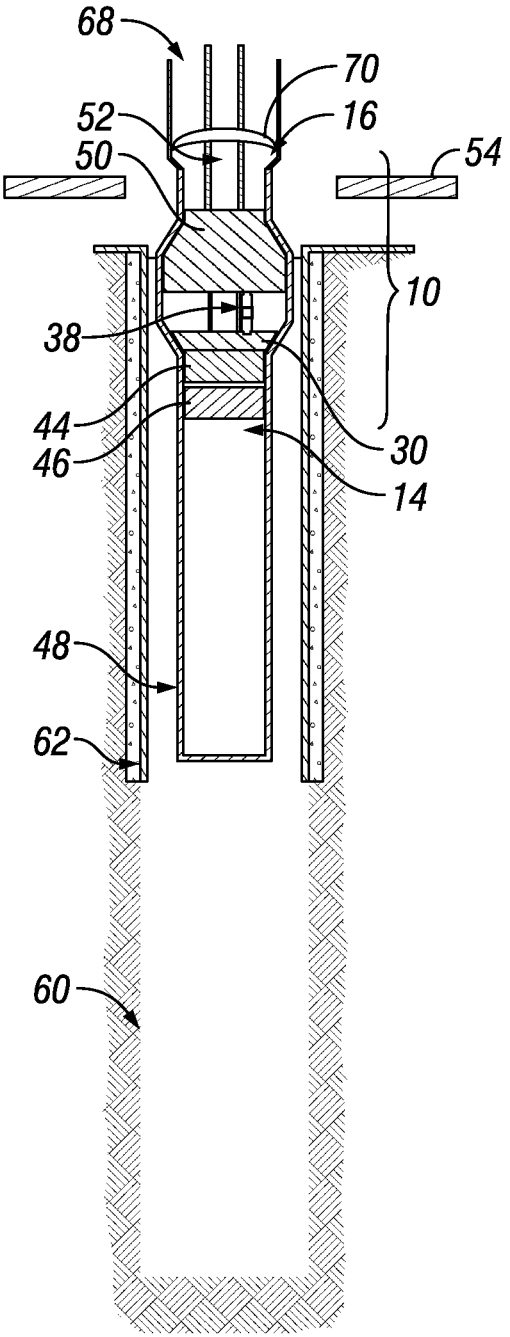
FIG. 2A is a schematic view of the liner hanger shown in FIG. 1 coupled to an expansion tool, wherein the liner hanger is suspended from a deck of a drilling rig, and wherein the expansion tool is lowered through the liner hanger.

Referring to FIGS. 1 and 2A, the liner hanger 10 may be hung from a deck 54 of a drilling rig, such as by using slips (not shown). The liner 48 is connected to the first end 14 of the liner hanger 10. Optionally, an operational pipe 68 may be connected to the second end 16 of the liner hanger 10. The flapper 38 may be maintained in the first position with the tube 42.

An expansion tool having an adjustable cone 50 and a cup seal 70, both attached to a work string 52, may be lowered into the liner hanger 10, such as by using a derrick (not shown). For example, the adjustable cone 50 may be of a type similar to the adjustable cone described in U.S. Pat. No. 9,085,967. When the adjustable cone 50 is in a retracted configuration, its outer diameter is less than the first inner diameter 22 of the expandable pipe 18. Accordingly, the adjustable cone 50 may pass through the expandable pipe 18 and reach the launcher chamber 20. Once in the launcher chamber 20, the adjustable cone 50 may be formed into an expanded configuration, wherein the outer diameter of the adjustable cone 50 is more than the first inner diameter 22.

Alternatively, the expansion tool having the adjustable cone 50 and the cup seal 70 may be preinstalled in the liner hanger 10 and operational pipe. The assembly including the expansion tool and the liner hanger 10 may be raised above the deck 54 using the derrick, and then the work string 52 may be attached to the expansion tool.

A shoulder 40 provided by a transition between the launcher chamber 20 and the expandable pipe 18 may rest on the adjustable cone 50 so that the liner 48 and the liner hanger 10 are suspended from the adjustable cone 50 and the work string 52. Note that the shoulder 40 and the adjustable cone 50 may cooperate to provide a stronger support between the liner hanger 10 and the work string 52 than provided by conventional retractable dogs engaging an inner groove of a conventional liner hanger. For example, the difference between the second inner diameter 24 and the first inner diameter 22 may be approximately 0.5 inches, which is typically larger than the difference between the diameter of the inner groove and the inner diameter engaged by the retractable dogs of a conventional liner hanger. The liner 48 may thus be deployed into the wellbore 60.

Figure 2B:
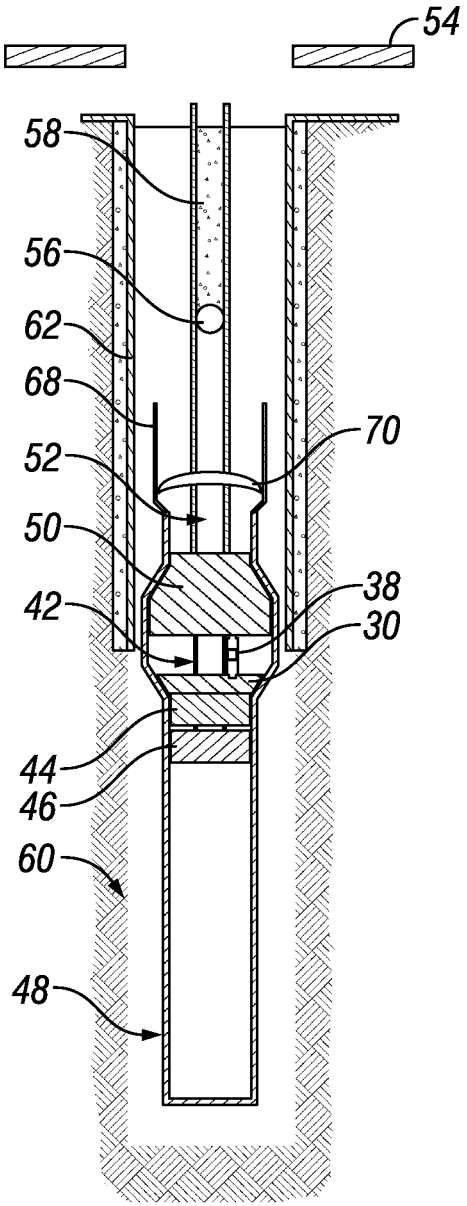
FIG. 2B is a schematic view of the liner hanger positioned in the wellbore at the beginning of a cementing operation.

Turning to FIG. 2B, the liner 48 and the liner hanger 10 are shown positioned in the wellbore 60. A cementing operation may begin with pumping a first ball 56, or dart, ahead of a cement slug 58. The first ball 56 is sized to pass through the tube 42 and the top wiper plug 44. The first ball 56 may thus land on the bottom wiper plug 46 and pressure applied to the cement slug 58 may shear off the bottom wiper plug 46 from the tubular body 12. Note that the liner hanger 10 does not require to be set against the base casing 62 to begin a cementing operation, as the liner hanger 10 may be sufficiently supported by the adjustable cone 50.

Figure 2C:
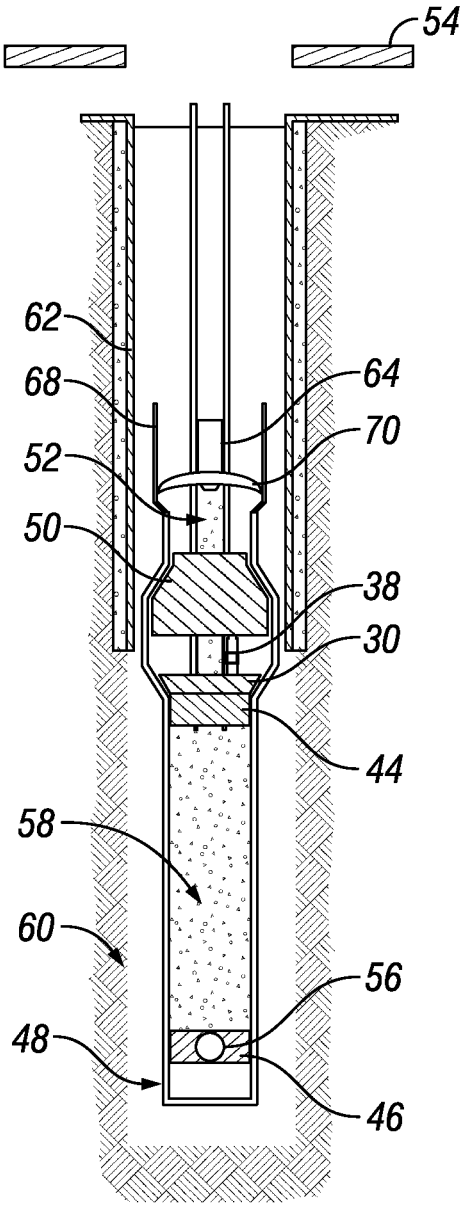
FIG. 2C is a schematic view of the liner hanger positioned in the wellbore, prior to squeezing a cement slug in an annulus between the liner and the wellbore.

Turning to FIGS. 1 and 2C, a wiper dart 64 may follow the cement slug 58 prior to squeezing the cement slug 58 in an annulus between the liner 48 and the wellbore 60. Note that the tube 42 may seal against an end of the work string 52, which traverses the adjustable cone 50. The tube 42 may maintain the flapper 38 in the first position, wherein the flapper 38 does not cover the flow passageway 32. Accordingly, the orifice 36 may not be eroded by the cement slug 58 flowing through the flow passageway 32. The wiper dart 64 may then land on the top wiper plug 44 and pressure applied to the cement slug 58 may shear off the top wiper plug 44 from the tubular body 12. The top wiper plug 44 may then carry the tube 42, and the flapper 38 may move to its second position wherein the flapper 38 covers the flow passageway 32.

Figure 2D:
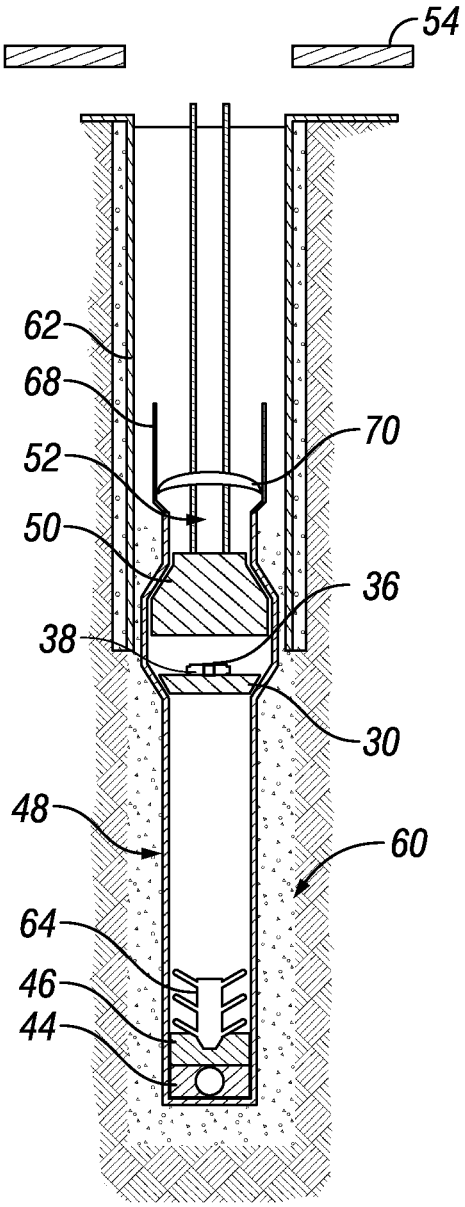
FIG. 2D is a schematic view of the liner hanger positioned in the wellbore, after squeezing the cement slug in the annulus between the liner and the wellbore.

Turning to FIG. 2D, the cement slug 58 has escaped the bottom of the liner 48 via a port, and is shown squeezed in the annulus between the liner 48 and the wellbore 60. Note also that the launcher chamber 20 and the adjustable cone 50 may further be sized for preventing the liner 48 from backing up when the cement slug 58 is squeezed in the annulus.

Figure 2E:
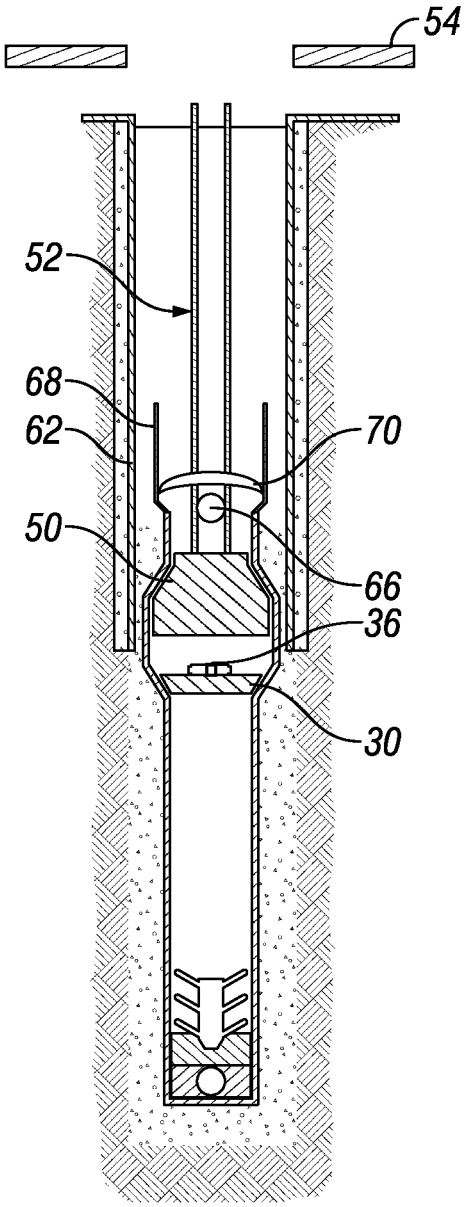
FIG. 2E is a schematic view of the liner hanger positioned in the wellbore, at the beginning of radially expanding the liner hanger.

Turning to FIGS. 1 and 2E, a ball 66 may be pumped down for radially expanding the liner hanger 10. The ball 66 may seat on and seal the orifice 36 of the flapper 38. Thus, a volume may be sealed within the tubular body 12 by the expansion pressure seat 30 and the cup seal 70. Fluid pumped through the work string 52 into the volume may apply an upward force to the seal cup and lift the adjustable cone 50. Accordingly, at least a portion, and optionally an entirety of the expandable pipe 18 may be radially expanded.

In other embodiment where a pressure seat is not provided, pumping down the ball 66 may not be needed. In such a case, the sealed volume may extend along the inner bore of the liner 48, down to the upper wiper plug 44. Note that a bottom-up expansion of the expandable pipe 18, when energized with hydraulic pressure as provided in this embodiment, does not require the liner hanger 10 to be set against the base casing 62 because the hydraulic pressure in the volume applies forces that are balanced.

Figure 2F:
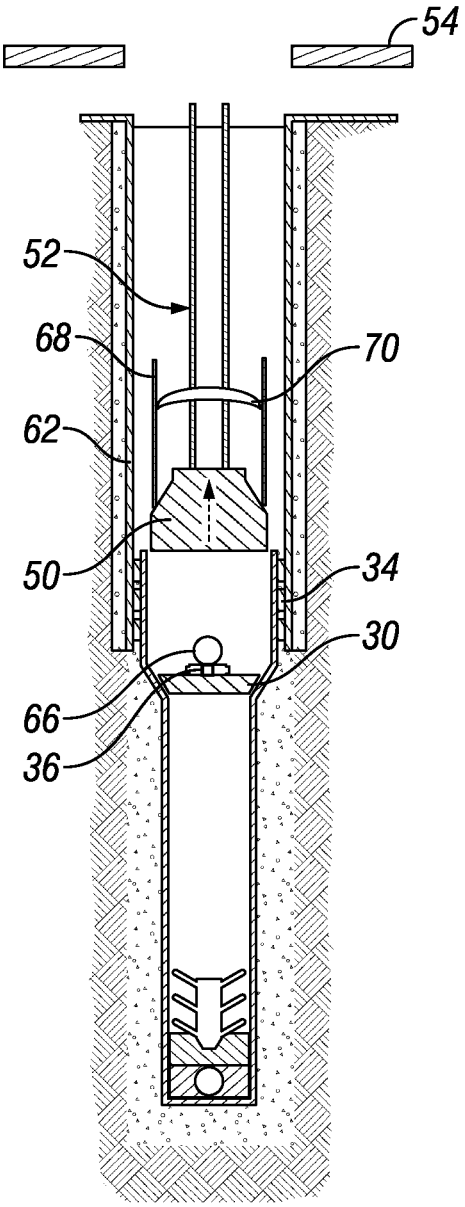
FIG. 2F is a schematic view of the expansion tool being retrieved from the wellbore.

Turning to FIG. 2F, the elastomer rings 34 may be compressed against the base casing 62, and may seal the annulus between the liner hanger 10 and the wellbore 60. The connection 26 between the liner hanger 10 and the operational pipe 68 may be released upon radial expansion of the expandable pipe, for example, as taught in U.S. Patent Application Pub. No. 2015/0285009. The expansion tool may then be retrieved from the wellbore 60, carrying the operational pipe 68 with it. Alternatively or additionally, the top of the expandable pipe 18 may be radially expanded by pulling on the work string 52.

Figure 2G:
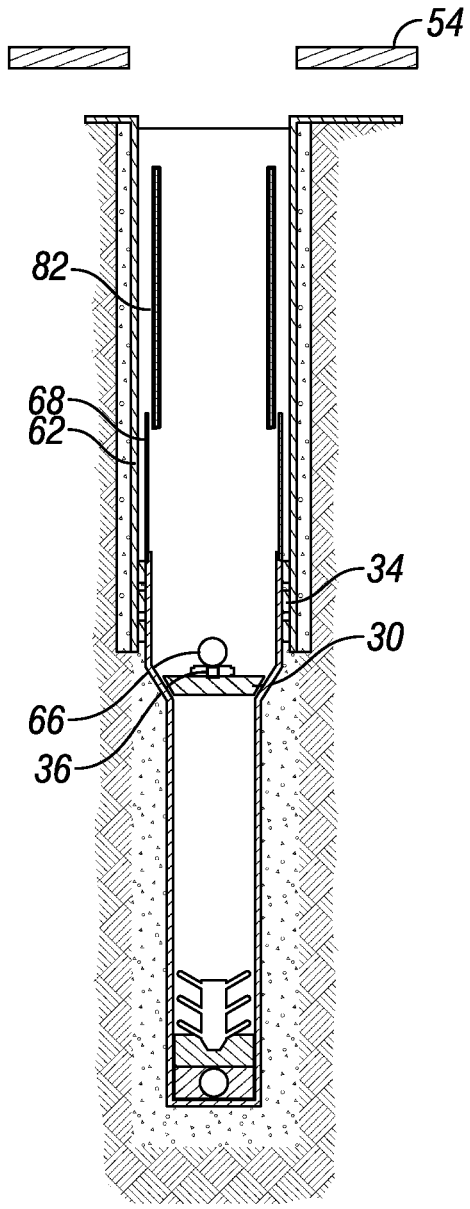
FIG. 2G is a schematic view of a tie-back liner installed after the expansion tool is retrieved from the wellbore.

In other embodiments, the connection 26 between the liner hanger 10 and the operational pipe 68 may not be released upon radial expanding of the expandable pipe. Since the operational pipe 68 may have a third inner diameter that is larger than the second inner diameter, the operational pipe 68 may remain connected to liner hanger 10. As such, the operational pipe 68 may serve as a bore receptacle for a tie-back liner 82 to be installed after the expansion tool is retrieved from the wellbore 60, for example, as illustrated in FIG. 2G.

Figure 3:
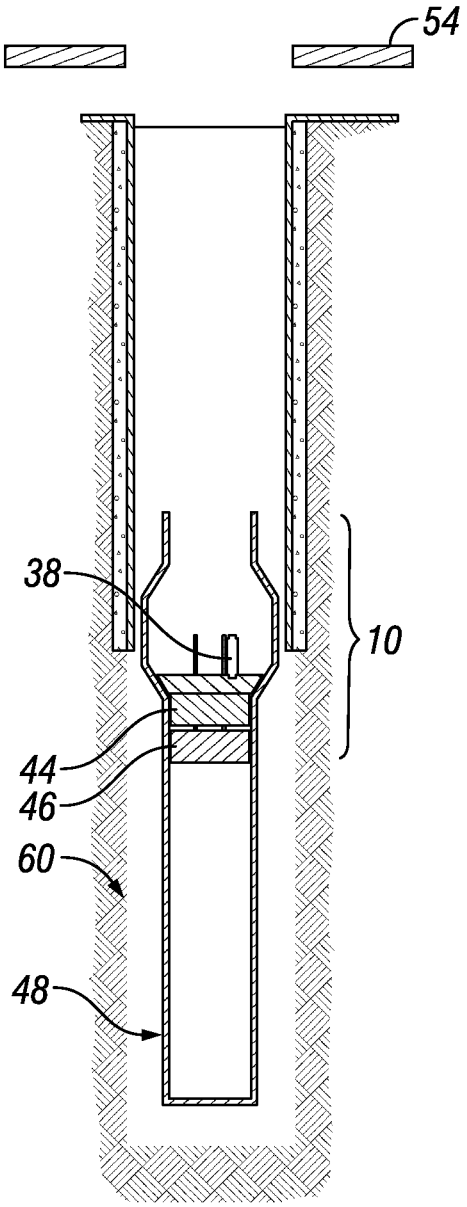
FIG. 3 is a schematic view of the liner hanger positioned in the wellbore similarly to FIG. 2B, wherein the expansion tool has been retrieved from the wellbore before the cementing operation.
Figure 4:
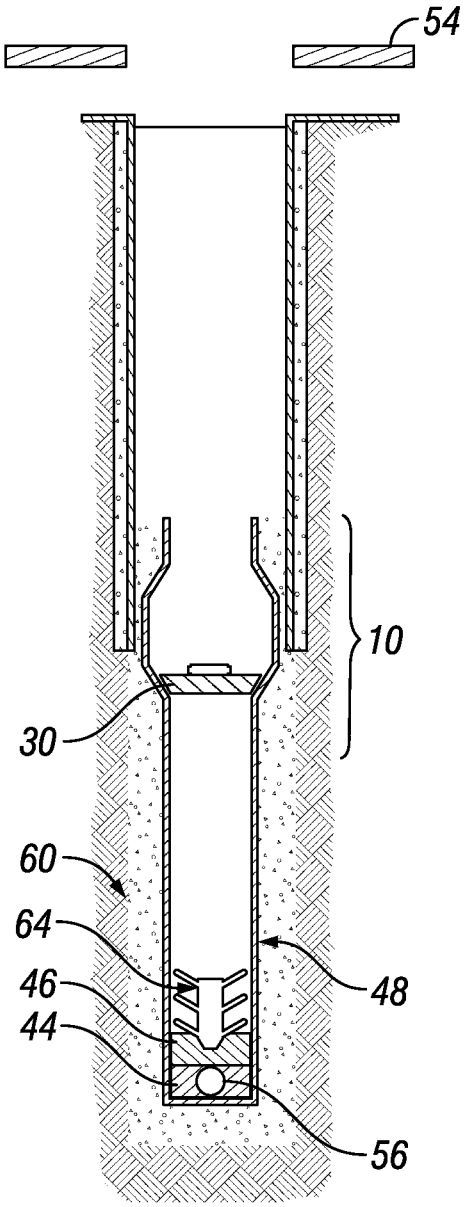
FIG. 4 is a schematic view of the liner hanger positioned in the wellbore similarly to FIG. 2E, wherein the expansion tool has been retrieved from the wellbore before radially expanding the liner hanger.

At any time during deployment of the liner hanger 10, including before radially expanding an entire length of the expandable pipe 18, the expansion tool may be released from the liner hanger 10 and retrieved to the surface, thus leaving the wellbore 60 accessible. If needed, the liner hanger 10 may then be milled. For example in FIG. 3, the expansion tool has been retrieved from the wellbore 60 before the cementing operation. In another example shown in FIG. 4, the expansion tool has been retrieved from the wellbore 60 before radially expanding the liner hanger 10. To do so, the adjustable cone 50 may be collapsed into the retracted configuration, for example as taught in U.S. Pat. No. 9,085,967.

After an interruption of operations or contingency pullout due to failure or other issue, the same or another expansion tool may be reinserted into the liner hanger 10 while the liner hanger 10 is still in the wellbore 60. The expansion tool may be lowered in the wellbore 60 with the adjustable cone 50 in the retracted configuration. After the adjustable cone 50 has been introduced through the expandable pipe 18 and has reached the launcher chamber 20, the adjustable cone 50 may be formed into the expanded configuration. At least a portion, and optionally an entirety of the expandable pipe 18 may then be radially expanded as previously described.

Figure 5:
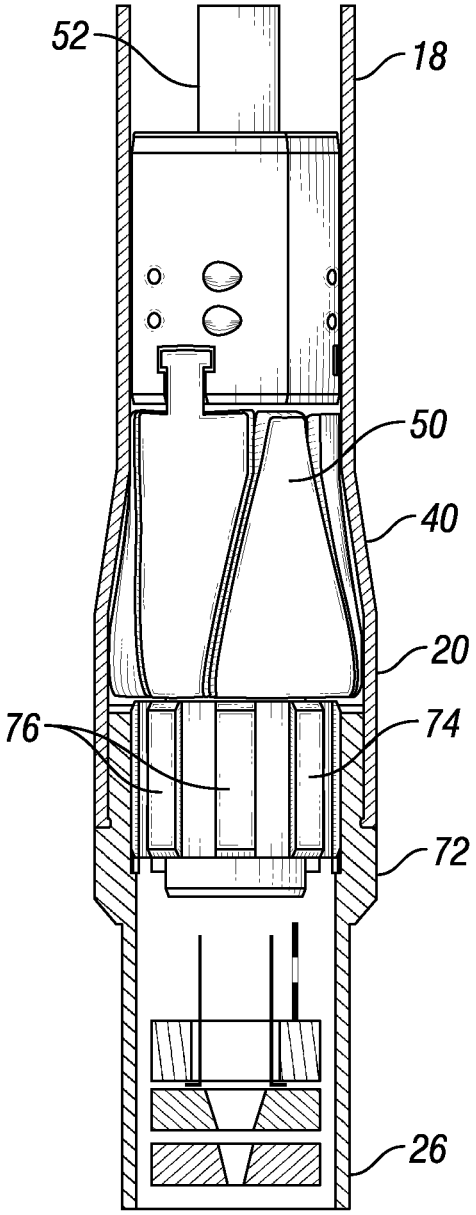
FIG. 5 is a schematic view of a portion of a liner hanger coupled to an expansion tool including a torque transfer device.
Figure 6:
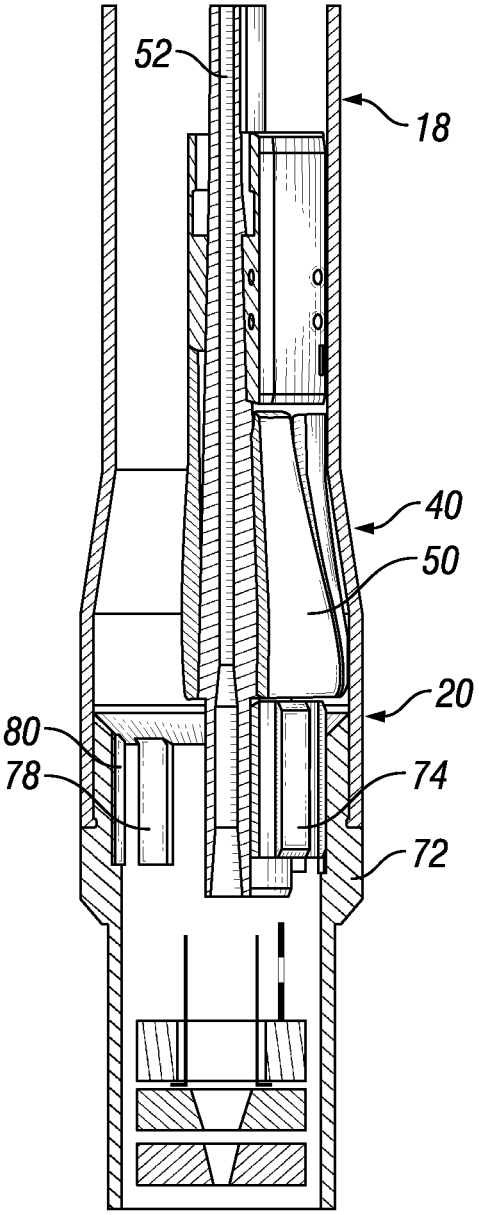
FIG. 6 is a schematic view of the portion of the liner hanger and expansion tool shown in FIG. 5, with a section of the expansion tool cut away.

In some embodiments, it may be useful to transmit torque from the work string 52 to the liner 48, for example, to make up connections between the liner 48 and other wellbore equipment, or to rotate the liner 48 in the wellbore 60. Referring to FIGS. 5 and 6, a portion of a liner hanger is illustrated coupled to an expansion tool including a torque transfer device. For example, the torque transfer device may include a torque transfer nut 74. The torque transfer nut 74 may be attached (e.g., threaded) to the work string 52 and/or to the adjustable cone 50. The torque transfer nut 74 may include one or more splines 76 that rotate with the work string 52 when the work string 52 is rotated at surface. Instead of or in addition to the splines 76, the torque transfer nut 74 may include lugs (not shown) that can retract within a body of the torque transfer nut 74. The splines or lugs are sized to be received in one or more corresponding grooves 78 formed in the launcher chamber 20 of the liner hanger. In the example shown, the launcher chamber 20 is at least partially formed in a crossover sub 72 threadedly coupled to the expandable pipe 18 below the shoulder 40. The grooves 78 are recessed within an internal cylindrical surface 80 of the crossover sub 72.

To insert the expansion tool into the liner hanger, the adjustable cone 50 may be collapsed in the retracted configuration. Once the transfer nut 74 is located in an upper portion of the launcher chamber 20, the work string 52 and the transfer nut 74 may be rotated to align the splines 76 with the corresponding grooves 78 formed in the launcher chamber 20. Once alignment is achieved, the work string 52 is further lowered so that the splines 76 engage the grooves 78. Then, the adjustable cone 50 may be formed in the expanded configuration in the launcher chamber 20 below the shoulder 40. As such, a torque applied to the work string 52 at surface is transmitted to the liner by the splines 76 of the torque transfer nut 74 engaging the grooves 78 formed into the crossover sub 72.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A system for deploying a liner into a wellbore, comprising:

a liner hanger, including a tubular body having a first end including a connection to the liner and a second end, the tubular body comprising:

an expandable pipe, a crossover sub, a launcher chamber located longitudinally between the first end and the expandable pipe, the launcher chamber being at least partially formed in the crossover sub, and a shoulder provided by a transition between the launcher chamber and the expandable pipe, wherein the expandable pipe has a first inner diameter, and the launcher chamber has a second inner diameter that is larger than the first inner diameter, and wherein the crossover sub is threaded to the expandable pipe below the shoulder; and an adjustable cone;

wherein the shoulder is configured to rest on a flared surface of the adjustable cone, the flared surface being capable of radially expanding at least a portion of the expandable pipe.

2. The system of claim 1, further comprising at least one seal member disposed around the expandable pipe.

3. The system of claim 2, further comprising an operational pipe, wherein the second end includes a sealed connection to the operational pipe, wherein the sealed connection is releasable upon radial expanding of the expandable pipe, and wherein the operational pipe has a third inner diameter that is larger than the second inner diameter.

4. The system of claim 2, further comprising:

an expansion pressure seat attached to the liner hanger and having a flow passageway; and a flapper having an orifice therethrough, wherein the flapper is capable of covering the flow passageway.

5. The system of claim 1, further comprising:

a work string attached to the adjustable cone;

a torque transfer nut attached to the work string; and at least one groove formed in the launcher chamber sized to receive a portion of the torque transfer nut.

6. The system of claim 5, wherein the at least one groove is recessed within an internal surface of the crossover sub.

7. A liner hanger for deploying a liner into a wellbore, the liner hanger including a tubular body having a first end configured to be connected to the liner and a second end, the tubular body comprising:

an expandable pipe;

a crossover sub;

a launcher chamber located longitudinally between the first end and the expandable pipe, the launcher chamber being at least partially formed in the crossover sub, wherein the expandable pipe has a first inner diameter, and the launcher chamber has a second inner diameter that is larger than the first inner diameter, a shoulder provided by a transition between the launcher chamber and the expandable pipe, wherein the crossover sub is threaded to the expandable pipe below the shoulder; and an operational pipe, wherein the second end includes a sealed connection to the operational pipe, wherein the sealed connection is releasable upon radial expanding of the expandable pipe, and wherein the operational pipe has a third inner diameter that is larger than the second inner diameter.

8. The liner hanger of claim 7, further comprising at least one groove formed in the launcher chamber, wherein the at least one groove is recessed within an internal surface of the crossover sub.

9. The liner hanger of claim 7, further comprising at least one seal member disposed around the expandable pipe.

10. The liner hanger of claim 7, further comprising:

an expansion pressure seat attached to the liner hanger and having a flow passageway; and a flapper having an orifice therethrough, wherein the flapper is capable of covering the flow passageway.

* * * * *